US009966187B2

(12) United States Patent
Aoki et al.

(10) Patent No.: US 9,966,187 B2
(45) Date of Patent: May 8, 2018

(54) COIL COMPONENT

(71) Applicant: TAIYO YUDEN CO., LTD., Taito-ku, Tokyo (JP)

(72) Inventors: Hidenori Aoki, Takasaki (JP); Takayuki Takano, Takasaki (JP); Tetsuo Kumahora, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days. days.

(21) Appl. No.: 14/811,443

(22) Filed: Jul. 28, 2015

(65) Prior Publication Data

US 2016/0027574 A1 Jan. 28, 2016

(30) Foreign Application Priority Data

Jul. 28, 2014 (JP) ..... 2014-152611

(51) Int. Cl.

| | |
|---|---|
| ***H01F 27/02*** | (2006.01) |
| ***H01F 27/24*** | (2006.01) |
| ***H01F 27/29*** | (2006.01) |
| ***H01F 17/04*** | (2006.01) |
| *H01F 27/28* | (2006.01) |
| *H01F 3/10* | (2006.01) |

(52) U.S. Cl.

CPC ..... *H01F 27/292* (2013.01); *H01F 17/045* (2013.01); *H01F 27/2823* (2013.01); *H01F 2003/106* (2013.01); *H01F 2017/048* (2013.01)

(58) Field of Classification Search

CPC .... H01F 27/29; H01F 27/2823; H01F 27/255; H01F 3/08; H01F 17/045; H01F 2017/048

USPC ..... 336/192, 233, 83

See application file for complete search history.

(56) References Cited

U.S. PATENT DOCUMENTS

| | | | | |
|---|---|---|---|---|
| 3,493,909 | A | 2/1970 | Beverly | |
| 4,777,461 | A | 10/1988 | Sakamoto | |
| 5,680,087 | A | 10/1997 | Sakata et al. | |
| 5,963,119 | A | 10/1999 | Takeda et al. | |
| 6,055,721 | A * | 5/2000 | Mamada | H01F 17/045 29/605 |
| 6,144,280 | A | 11/2000 | Amada et al. | |
| 6,392,523 | B1 | 5/2002 | Tsunemi | |
| 7,358,843 | B2 * | 4/2008 | Takayama | H04B 15/02 336/200 |

(Continued)

FOREIGN PATENT DOCUMENTS

| | | | |
|---|---|---|---|
| JP | 2008166596 | A | 7/2008 |
| JP | 2011165696 | A | 8/2011 |

*Primary Examiner* — Mangtin Lian

(74) *Attorney, Agent, or Firm* — Law Office of Katsuhiro Arai

(57) ABSTRACT

A coil component includes: a pillar part, quadrangular planar parts formed at both ends of the pillar part, a coil formed by winding an insulating sheath conductor around the pillar part, electrode terminals that are electrically connected to both ends of the coil, and an outer sheath covering the coil at least partially; wherein the pillar part and quadrangular planar parts are made of ferrite material; the outer sheath contains metal magnetic grains and resin material; and based on a section obtained by cutting through the center of the pillar part vertically to the long-axis direction of the pillar part, the cross-section area of the pillar part is greater than the cross-section area of the outer sheath.

11 Claims, 2 Drawing Sheets

(56) References Cited

U.S. PATENT DOCUMENTS

| | | | | |
|---|---|---|---|---|
| 7,477,122 | B2 | 1/2009 | Iguchi et al. | |
| 8,212,641 | B2 * | 7/2012 | Wu | H01F 17/045 336/221 |
| 8,438,720 | B2 * | 5/2013 | Muneuchi | H01F 17/045 29/602.1 |
| 9,147,514 | B2 * | 9/2015 | Nakada | H01F 27/00 |
| 2001/0038327 | A1 | 11/2001 | Aoki et al. | |
| 2006/0071749 | A1 | 4/2006 | Aoki et al. | |
| 2007/0146110 | A1 | 6/2007 | Oki | |
| 2008/0309443 | A1 | 12/2008 | Furuya | |
| 2010/0182115 | A1 * | 7/2010 | Huang | H01F 17/045 336/83 |
| 2012/0038449 | A1 * | 2/2012 | Ogawa | H01F 1/33 336/221 |
| 2012/0086534 | A1 * | 4/2012 | Wu | H01F 17/045 336/83 |
| 2013/0186995 | A1 | 7/2013 | Yamaguchi et al. | |
| 2013/0328653 | A1 * | 12/2013 | Wu | H01F 3/08 336/83 |
| 2014/0070914 | A1 | 3/2014 | Oki | |
| 2015/0002252 | A1 | 1/2015 | Masaki et al. | |
| 2015/0235758 | A1 | 8/2015 | Takagi et al. | |
| 2016/0035482 | A1 | 2/2016 | Aoki et al. | |

* cited by examiner

[Fig. 1]
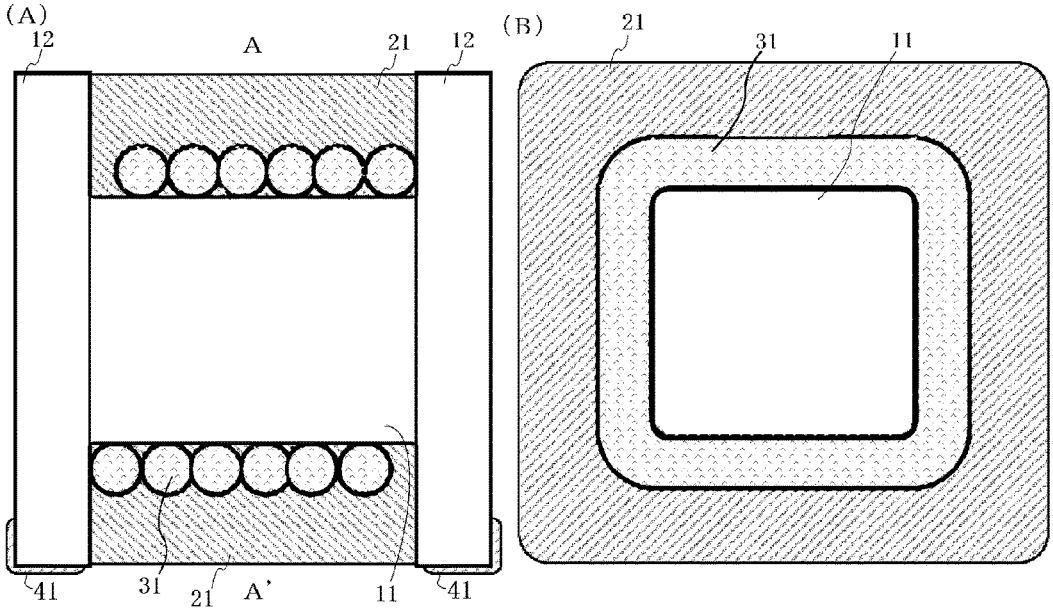
[Fig. 2]
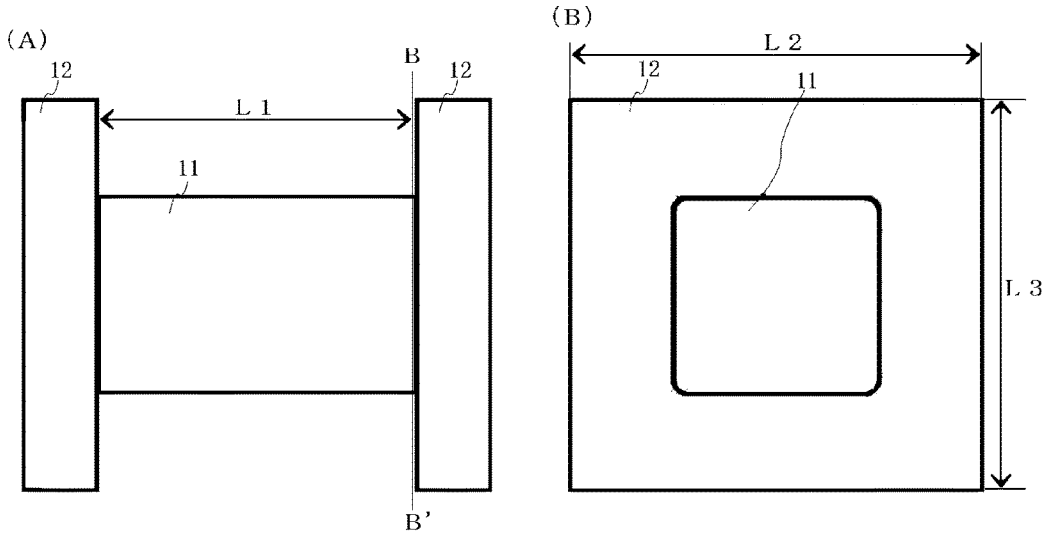

[Fig. 3]
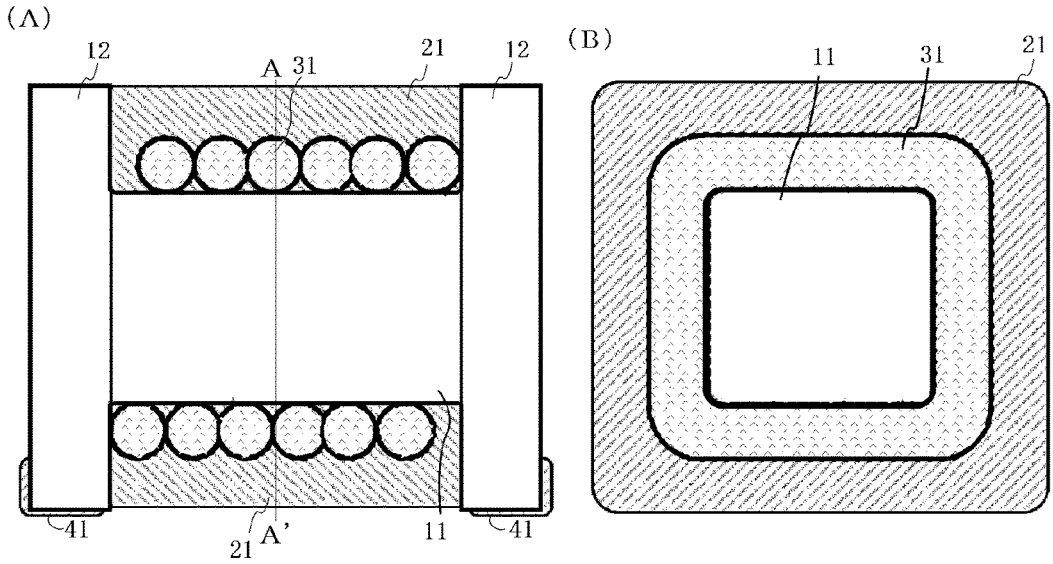
[Fig. 4]
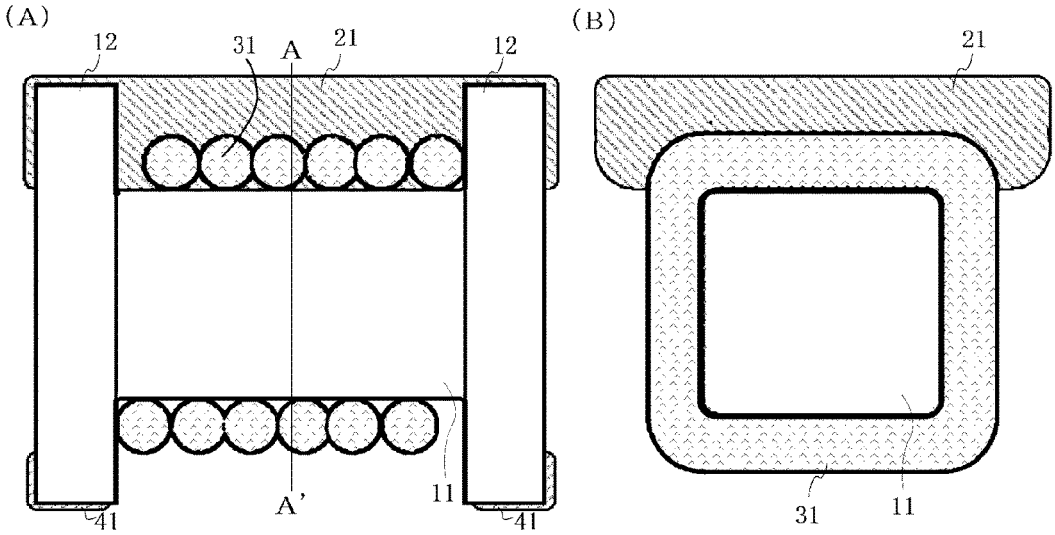

COIL COMPONENT

BACKGROUND

Field of the Invention

The present invention relates to a coil component having a so-called drum core.

Description of the Related Art

There is a type of coil component referred to as the drum coil component, which has a drum core made of magnetic material, etc., and a coil formed by winding an insulating sheath conductor around the core. Mobile devices and other electronic devices of higher performance are required, which gives rise to a need for supplying high-performance components. Coil components are increasingly used in applications requiring high saturated current, and coil components of high withstand voltage are also in demand. In light of the above, there is a need for coil components that offer both high insulation property and high current characteristics.

According to the art described in Patent Literature 1, a coil component is provided by combining a ferrite core with an outer sheath containing ferrite powder, to achieve high inductance. Such coil component uses sintered ferrite powder, but such sintered powder maintains large specific surface area regardless of how it is produced, such as sintering a magnetic substance in powder form or crushing a sintered magnetic substance, and because a kneaded mixture of sintered powder and resin cannot have low viscosity, and for other reasons, the fill ratio of sintered powder needs to stay low. As a result, efforts have been made to achieve high inductance by making the outer sheath thicker and thereby achieving high shielding effect.

Any discussion of problems and solutions involved in the related art has been included in this disclosure solely for the purposes of providing a context for the present invention, and should not be taken as an admission that any or all of the discussion were known at the time the invention was made.

BACKGROUND ART LITERATURES

[Patent Literature 1] Japanese Patent Laid-open No. 2008-166596

SUMMARY

However, the aforementioned art of Patent Literature 1, while achieving high inductance, results in low saturated current because the ferrite core saturates easily.

In light of the above, an object of the present invention is to provide a coil component that exhibits high saturated current without causing the inductance or insulation property to drop.

After studying in earnest, the inventors of the present invention completed the present invention described below:

(1) A coil component having: a pillar part; quadrangular planar parts formed at both ends of the pillar part; a coil formed by winding an insulating sheath conductor around the pillar part; electrode terminals that are electrically connected to both ends of the coil; and an outer sheath covering the coil at least partially; wherein the pillar part and quadrangular planar parts are made of ferrite material; the outer sheath contains metal magnetic grains and resin material; and, based on a section obtained by cutting through the center of the pillar part vertically to the long-axis direction of the pillar part, the cross-section area Si of the pillar part is greater than the cross-section area S2 of the outer sheath.

(2) A coil component according to (1), wherein the length of the long axis of the pillar part is greater than the length of the longest side of the quadrangular planar part.

(3) A coil component according to (1) or (2), wherein the outer sheath contains metal magnetic grains by 50 to 90 percent by volume.

(4) A coil component according to any one of (1) to (3), wherein the outer sheath contains non-crystalline metal magnetic grains.

(5) A coil component according to any one of (1) to (4), wherein the insulating sheath conductor is wound only around the pillar part.

(6) A coil component according to any one of (1) to (5), wherein the cross-section area S2 is about 0.2 to about 0.95 times the cross-section area S1.

According to the present invention, a coil component that offers both high inductance and high saturated current is provided. To be specific, the saturation point of the pillar part made of ferrite material can be raised, and consequently high saturated current is achieved, by making the cross-section area of the pillar part greater than that of the outer sheath containing metal magnetic grains. The pillar part and quadrangular planar parts assure high insulation property because they are made of ferrite material, which is advantageous when manufacturing small components such as chip components. Ideally the long axis of the pillar part is longer than the longest side of the quadrangular planar part, as this increases the ratio of the magnetic path being occupied by the outer sheath, which in turn reduces the impact of the outer sheath and allows for better utilization of the performance of the magnetic substance, and consequently the saturation characteristics of the magnetic substance are effectively utilized and high saturated current is achieved.

According to a favorable embodiment of the present invention, high inductance can be achieved even when the outer sheath is occupied by many metal magnetic grains and the outer sheath is thin. According to another favorable embodiment, the outer sheath contains non-crystalline metal magnetic grains, which in turn increases the filling property and allows for reduction of the thickness of the outer sheath, thus making it possible to further raise the saturated current. According to yet another favorable embodiment, the insulating sheath conductor is wound only around the pillar part, because this prevents so-called winding bulge and allows the size of the pillar part to be increased by a corresponding amount, while also keeping the outer sheath less varied in terms of dimensions.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

Description of the Symbols

11: Pillar part; 12: Quadrangular planar part; 21: Outer sheath; 31: Coil; 41: Electrode terminal

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 1 is a schematic diagram of a coil component in an embodiment of the present invention; (A) is a schematic view of a section cut along the long-axis direction of the pillar part, while (B) is a plan view showing section A-A' in (A).

FIG. 2 is a schematic diagram of a pillar part and quadrangular planar part in an embodiment of the present invention; (A) is a schematic view of a section cut along the long-axis direction of the pillar part, while (B) is a view showing section B-B' in (A).

FIG. 3 is a schematic diagram of a coil component in an embodiment of the present invention; (A) is a schematic view of a section cut along the long-axis direction of the pillar part, while (B) is a view showing section B-B' in (A).

FIG. 4 is a schematic diagram of a coil component in an embodiment of the present invention; (A) is a schematic view of a section cut along the long-axis direction of the pillar part, while (B) is a view showing section B-B' in (A).

DETAILED DESCRIPTION OF EMBODIMENTS

The present invention is described in detail below by referring to the drawings as deemed necessary. It should be noted, however, that the present invention is not limited to the illustrated embodiments and that, because characteristic parts of the invention may be emphasized in the drawings, the scale of each part of the drawings is not necessarily accurate.

The coil component proposed by the present invention is a coil component having a core and a coil wound around the core's pillar part.

FIG. 1 is a schematic diagram of a coil component in an embodiment of the present invention. In this figure, (A) is a schematic view of a section cut along the long-axis direction of the pillar part, while (B) is a view showing section A-A' in (A). The core has a pillar part 11 and quadrangular planar parts 12. FIG. 2 is a schematic diagram of a pillar part and quadrangular planar part in an embodiment of the present invention. In this figure, (A) is a schematic view of a section cut along the long-axis direction of the pillar part, while (B) is a view showing section B-B' in (A).

The shape of the pillar part 11 is not limited in any way so long as it has an area around which the insulating sheath conductor can be wound, but preferably it is a solid shape such as cylinder or prism having a long axis of length L1 in one direction. The quadrangular planar parts 12 are each provided at one of the two ends of the long axis, and each have a sheet-like structure of a quadrangular shape having a specified thickness. Ideally the quadrangular shape is a rectangular shape having long side L2 and short side L3, as illustrated. Both ends of the long axis of the pillar part 11 are ideally contacting the centers of the quadrangular shapes of the quadrangular planar parts 12. The pillar part 11 and quadrangular planar parts 12 may be integrally constituted. Ideally at least one quadrangular planar part 12 has an electrode terminal 41. The electrode terminal 41 is electrically connected to the coil end described later, and normally the coil component of the present invention is electrically connected to a board, etc., via the electrode terminal 41.

Preferably the length L1 of the long axis of the pillar part 11 is longer than the longest side of the quadrangular planar part 12. This way, the ratio of the magnetic path being occupied by the outer sheath increases, which in turn reduces the impact of the outer sheath and allows for better utilization of the performance of the magnetic substance, and consequently the saturation characteristics of the magnetic substance are effectively utilized and high saturated current is achieved. The pillar part 11 and two quadrangular planar parts 12 constitute a drum core. In the following explanations, the pillar part 11 and two quadrangular planar parts 12 may be collectively referred to as "core."

The pillar part 11 and quadrangular planar parts 12 are made of ferrite material. Ferrite material is a material so formed as to exhibit magnetic property in an iron oxide or a complex oxide of iron and other metal, and any known ferrite material can be used without limitation. For example, Ni—Zn ferrite or Mn—Zn ferrite with a magnetic permeability of around 200 to 2000 can be used favorably. Such ferrite material is mixed with a binder and pressure is applied to the mixture using metal dies to form a drum shape, which is then sintered or otherwise treated to obtain the pillar part 11 and quadrangular planar parts 12. The ferrite material may be glass-coated or given other powder treatment. For the specific method for forming a core from ferrite material, and the like, any prior art can be referenced as deemed necessary.

An insulating sheath conductor is wound around the pillar part 11 of the core to obtain a coil 31. Also, electrode terminals 41 are formed, preferably on the quadrangular planar parts 12. For an embodiment of the insulating sheath conductor and the form and method for obtaining the coil 31 by winding the insulating sheath conductor around the pillar part 11, and the like, any prior art can be referenced as deemed necessary. Ideally the insulating sheath conductor is wound only around the pillar part 11, which is to say that a coil is formed with a single layer by traversing, meaning that the insulating sheath conductor is wound in such a way that adjacent sections do not overlap with each other. This prevents the aforementioned undesirable winding bulge. The electrode terminals 41 are electrically connected to both ends of the coil 31, respectively, and can be used as points of external contact for the coil component of the present invention. The shape and manufacturing method of the electrode terminal 41 are not limited in any way, and ideally it is formed by plating, and more preferably it contains Ag, Ni, and Sn. For example, an Ag paste is applied onto the quadrangular planar part 12 and then baked to form a base, after which the base is Ni- and Sn-plated and a solder paste is applied on top, which is followed by melting of the solder to embed the end of the coil, thereby electrically joining the coil and electrode terminal 41.

The coil 31 is covered by an outer sheath 21 at least partially, and the outer sheath 21 contains resin material and metal magnetic grains. The presence of the outer sheath increases the shielding property of the magnetic flux. Ideally the metal magnetic grains account for 50 to 90 percent by volume of the weight of the outer sheath. By increasing the ratio of content of the metal magnetic grains this way, high inductance can be expected.

Metal magnetic grain is a material constituted in such a way that it exhibits magnetic property in the metal areas that are not oxidized, and examples include, among others, metal grains and alloy grains that are not oxidized, as well as grains comprising the foregoing grains with oxide, etc., provided around them.

The outer sheath 21 contains such metal magnetic grains and resin material. For example, the outer sheath 21 is formed with a kneaded mixture of metal magnetic grains and resin covering the outside of the coil 31. In terms of the application method, the outer sheath 21 may be obtained by means of roller transfer or thermosetting, or the outer sheath 21 may be formed partially by placing a semi-finished outer sheath 21 before forming in resin-filled dies and curing it, or by means of dipping, etc. The metal magnetic grains for outer sheath 21 may be made of alloy materials such as Fe—Si—Cr, Fe—Si—Al and Fe—Ni, non-crystalline materials such as Fe—Si—Cr—B—C, Fe—Si—B—Cr and Fe, or materials formed by mixing the foregoing, and preferably their average grain size is 2 to 30 μm. The resin material for outer sheath is not limited in any way, and examples include, but are not limited to, epoxy resin, phenol resin, and polyester resin, among others.

Preferably the aforementioned non-crystalline metal magnetic grains are contained in the outer sheath 21. This way, high filling becomes possible and the saturated current can be raised further. Whether the outer sheath 21 contains non-crystalline metal magnetic grains can be confirmed by checking, using the X-ray diffraction measuring method, if the diffraction pattern is broad.

Metal magnetic grains include, for example, grains manufactured by the atomization method. To be specific, any known alloy grain manufacturing method can be adopted, or any commercially available product such as PF-20F manufactured by Epson Atmix Corporation or SFR-FeSiAl manufactured by Nippon Atomized Metal Powders Corporation may be used. The method for obtaining an outer sheath 21 from metal magnetic grains is not limited in any way, and any known means based on coating technology or coating film forming technology can be employed as deemed appropriate.

Under the present invention, the magnitude correlation of the cross-section area 51 of the pillar part 11 and cross-section area S2 of the outer sheath 21 is important. Both cross-section areas S1, S2 are obtained based on a section obtained by cutting through the center of the pillar part 11 vertically to the long-axis direction of the pillar part 11. This section corresponds to section A-A' in FIG. 1(A), and FIG. 1(B) is a plan view of this section. Based on this section, the area occupied by the pillar part 11 is S1, while the area occupied by the outer sheath 21 is S2. Under the present invention, S1>S2 holds and preferably S2 is 0.2 to 0.95 times S1. By making the cross-section area of the pillar part 11 greater than that of the outer sheath 21, the saturation point of the pillar part 11 made of ferrite material can be raised and higher saturated current can be achieved.

FIGS. 3 and 4 are each a schematic diagram of a coil component in a different embodiment of the present invention. Section A-A' in FIG. 3(A) is illustrated in FIG. 3(B), while section A-A' in FIG. 4(A) is illustrated in FIG. 4(B). In the embodiment in FIG. 3, the coating thickness of the outer sheath 21 is smaller than that in the embodiment in FIG. 1. In the embodiment in FIG. 4, the outer sheath 21 covers the coil 31 only partially. Additionally, when the outer sheath 21 is provided only partially, it is easy to position the electrode terminals 41 and outer sheath 21 so that they do not contact each other, which allows for higher withstand voltage. Coil components according to these embodiments are also included in the present invention.

EXAMPLE

The present invention is explained in greater detail below using examples. It should be noted, however, that the present invention is not limited to the embodiments described in these examples.

A coil component was manufactured as follows:

Drum core whose core size (long axis of the pillar part x vertical dimension of the quadrangular planar part x lateral dimension of the quadrangular planar part) is:
2.0×2.0'2.0 mm (Example 1, Comparative Example 1); or
2.0×1.6×1.6 mm (other than the above)

Ferrite material for core: Ni—Zn ferrite powder was compression-molded and then sintered at 1000° C.

Coil: Copper wire coated with polyimide resin, Ø0.1 mm

Number of windings: 10 turns

Electrode terminal: Ag paste (sintered)+Ag paste (cured)+Ni/Sn plating

Resin for outer sheath: Epoxy resin

A core constituted by a pillar part 11 and quadrangular planar part 12 was obtained by compacting a Ni—Zn ferrite material to the aforementioned dimensions and then sintering the shaped material at 1000° C. The coil was obtained by winding an insulating sheath conductive wire according to the aforementioned conditions. Electrode terminals 41 were formed by baking an Ag paste, applying an Ag paste on top and curing it, and then plating the top surface with Ni/Sn. An outer sheath 21 was produced according to the conditions shown in Table 1 below. In Example 4, the coil 31 was covered with the outer sheath 21 only partially, as illustrated in FIG. 4.

TABLE 1

| | Cross-section area S1 | Outer sheath material | Fill ratio | Cross-section area S2 | S2/S1 |
|---|---|---|---|---|---|
| Comparative Example 1 | 1.00 $mm^2$ | FeSiCr | 70% | 1.25 $mm^2$ | 1.25 |
| Example 1 | 1.21 $mm^2$ | FeSiCr | 70% | 0.94 $mm^2$ | 0.78 |
| Comparative Example 2 | 0.88 $mm^2$ | FeSiCr | 70% | 1.11 $mm^2$ | 1.25 |
| Example 2 | 1.04 $mm^2$ | FeSiCr | 75% | 0.93 $mm^2$ | 0.89 |
| Example 3 | 1.10 $mm^2$ | FeSiCrB | 85% | 0.55 $mm^2$ | 0.50 |
| Example 4 | 1.26 $mm^2$ | FeSiCrB + Fe | 88% | 0.20 $mm^2$ | 0.16 |

The materials for outer sheath are as follows:

FeSiCr—Crystalline material constituted by 92 percent by weight of Fe, 3 percent by weight of Si, and 5 percent by weight of Cr FeSiCrB—Non-crystalline material constituted by 93 percent by weight of Fe, 3 percent by weight of Si, 3 percent by weight of Cr, and 1 percent by weight of B FeSiCrB+Fe—Mixed material constituted by 60 parts by weight of FeSiCrB above and 40 parts by weight of Fe (purity: 99.6 percent)

(Evaluation)

For each sample, inductance at 1 MHz was obtained using a LCR meter.

In addition, direct current was applied to each sample to lower the inductance, and when the inductance dropped to 0.7 μH, the corresponding current was evaluated as saturated current.

The values of inductance and saturated current are shown in Table 2 below.

TABLE 2

| | Inductance [μH] | Saturated current [A] |
|---|---|---|
| Comparative Example 1 | 1.01 | 2.43 |
| Example 1 | 1.09 | 2.79 |
| Comparative Example 2 | 1.08 | 1.60 |
| Example 2 | 1.12 | 2.09 |
| Example 3 | 1.10 | 2.24 |
| Example 4 | 1.08 | 2.19 |

When samples of identical dimensions were compared, the samples in the Examples achieved higher inductance and higher saturated current than those in the Comparative Examples.

The present invention includes the above mentioned embodiments and other various embodiments including the following: The pillar part has a quadrangular cross section which is substantially homologous to or different from the cross section of the quadrangular planar part, and which is edge-rounded to the degree where the shape is between a quadrangle and a circle or ellipse, wherein the quadrangle is a square or rectangle or lozenge; the pillar part has a polygonal cross section other than a quadrangular cross section; the planar parts are substantially quadrangular and edge-rounded wherein the quadrangle is a square or rectangle or lozenge; S2/S1 is 0.6±0.3, ±0.2, or ±0.1; S1>S2 for all cross sections of the pillar part between the quadrangular planar parts, typically for a cross section at the midpoint between the quadrangular planar parts, or only for a cross section where a coil is formed or for a cross section obtained by cutting through the outermost periphery of a coil; L1=L2 or L1>L2 by up to 30%.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2014-152611, filed Jul. 28, 2014, the disclosure of which is incorporated herein by reference in its entirety, including any and all particular combinations of the features disclosed therein, for some embodiments.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component comprising:

a pillar part;

quadrangular planar parts formed at both ends of the pillar part;

a coil formed by winding an insulating sheath conductor around the pillar part;

electrode terminals that are electrically connected to both ends of the coil; and an outer sheath covering the coil at least partially;

wherein the pillar part and quadrangular planar parts are made of ferrite material which is an iron oxide or a complex oxide of iron and other metal;

the outer sheath contains metal magnetic grains and resin material; and based on a cross section obtained by cutting through a center of the pillar part perpendicularly to a long-axis direction of the pillar part, a cross-section area S1 of the pillar part is greater than a cross-section area S2 of the outer sheath, wherein the cross-section area S2 is 0.5 to 0.89 times the cross-section area S1.

2. A coil component according to claim 1, wherein a length of a long axis of the pillar part is greater than a length of a longest side of the quadrangular planar part.

3. A coil component according to claim 1, wherein the outer sheath contains metal magnetic grains by 50 to 90 percent by volume.

4. A coil component according to claim 2, wherein the outer sheath contains metal magnetic grains by 50 to 90 percent by volume.

5. A coil component according to claim 1, wherein the outer sheath contains non-crystalline metal magnetic grains.

6. A coil component according to claim 2, wherein the outer sheath contains non-crystalline metal magnetic grains.

7. A coil component according to claim 3, wherein the outer sheath contains non-crystalline metal magnetic grains.

8. A coil component according to claim 1, wherein the insulating sheath conductor is wound only around the pillar part.

9. A coil component according to claim 2, wherein the insulating sheath conductor is wound only around the pillar part.

10. A coil component according to claim 3, wherein the insulating sheath conductor is wound only around the pillar part.

11. A coil component according to claim 4, wherein the insulating sheath conductor is wound only around the pillar part.

* * * * *